US008634739B2

(12) United States Patent
Xie

(10) Patent No.: US 8,634,739 B2
(45) Date of Patent: Jan. 21, 2014

(54) CHARGE ROLLER CONDUCTIVE FILM AND DEVELOPER CARTRIDGE

(75) Inventor: Haijun Xie, Guangdong (CN)

(73) Assignee: Print-Rite Unicorn Image Products Co., Ltd. of Zhuhai, Zhubai, Guangdong (CN)

( * ) Notice: Subject to any disclaimer, the term of this patent is extended or adjusted under 35 U.S.C. 154(b) by 236 days.

(21) Appl. No.: 13/123,343

(22) PCT Filed: Nov. 12, 2009

(86) PCT No.: PCT/CN2009/074907

§ 371 (c)(1),
(2), (4) Date: Apr. 8, 2011

(87) PCT Pub. No.: WO2010/057417

PCT Pub. Date: May 27, 2010

(65) Prior Publication Data

US 2011/0243602 A1 Oct. 6, 2011

(30) Foreign Application Priority Data

Nov. 19, 2008 (CN) ..... 2008 2 0203938 U

(51) Int. Cl.
*G03G 15/00* (2006.01)

(52) U.S. Cl.
USPC ..... 399/89; 399/90; 399/111; 399/115

(58) Field of Classification Search
USPC ..... 399/111, 115–117, 89–90
See application file for complete search history.

(56) References Cited

U.S. PATENT DOCUMENTS

| | | | | |
|---|---|---|---|---|
| 6,508,601 | B1 * | 1/2003 | Lui et al. | 400/679 |
| 2003/0123896 | A1 * | 7/2003 | Goto et al. | 399/90 |
| 2005/0191079 | A1 * | 9/2005 | Yokoi et al. | 399/90 |
| 2006/0104681 | A1 | 5/2006 | Hanashi | |
| 2009/0180801 | A1 * | 7/2009 | Kuwabara et al. | 399/117 |
| 2011/0013925 | A1 * | 1/2011 | Kim et al. | 399/90 |

FOREIGN PATENT DOCUMENTS

| | | | |
|---|---|---|---|
| CN | 2906694 | | 5/2007 |
| CN | 201035326 | | 3/2008 |
| CN | 201340516 | Y | 11/2009 |
| JP | 7-219307 | A | 8/1995 |

OTHER PUBLICATIONS

International Search Report dated Jan. 12, 2011.

* cited by examiner

*Primary Examiner* — Walter L Lindsay, Jr.
*Assistant Examiner* — Jessica L Eley
(74) *Attorney, Agent, or Firm* — Cozen O'Connor

(57) ABSTRACT

A charge roller conductive film and a developer cartridge. The conductive film has an input contacting an electrical contact of an image forming apparatus main assembly, an output electrically connecting with a charge roller and a transmission section connecting with the input and the output. The input has a middle contact plate shaped like a bent strip. A side contact plate is formed on at least one side of the middle contact plate.

18 Claims, 6 Drawing Sheets

CHARGE ROLLER CONDUCTIVE FILM AND DEVELOPER CARTRIDGE

CROSS-REFERENCE TO RELATED APPLICATIONS

This application claims priority from international application No. PCT/CN2009/074907 filed on Nov. 12, 2009, which claims priority from Chinese patent application No. 200820203938.3 filed on Nov. 19, 2008. These applications are incorporated herein by reference.

FIELD OF THE INVENTION

The present invention relates to a charge roller conductive film used in an image forming apparatus developer cartridge and a developer cartridge having the conductive film.

BACKGROUND OF THE INVENTION

A developer cartridge used in a laser printer and other image forming apparatus are generally divided into two types: an all-in-one cartridge and a split cartridge. The all-in-one cartridge is formed by a combination of a developing unit and a processing unit permanently connected to each other, and is used as one assembled inside the laser printer. The split cartridge refers to a developer cartridge in which the above developing unit and processing unit can relatively be removed by a user, and the developing unit can be individually replaced. The developing unit mainly comprises a developing unit frame, a developer chamber, an agitator, a toner supply roller, a developing roller and a toner deposit blade. The agitator, the toner supply roller and the developing roller can be rotatably assembled on the developing unit frame. The processing unit mainly comprises a processing unit frame, a waste toner chamber, a photosensitive drum, a charge roller and a cleaning blade. The photosensitive drum and the charge roller can be rotatably assembled on the processing unit frame. In the developing unit, the developer chamber provides a developer storage space and an appropriate developer transmission channel; the agitator can make a stand-by developer exported to the developing roller to be uniformly distributed through its own rotation; and the developing roller adjacent to the photosensitive drum makes the developer to be adsorbed to the electrostatic latent image region on the photosensitive drum through the role of opposite polarity charge. The charge roller of the processing unit provides charging to the photosensitive drum causing the photosensitive area of the photosensitive drum to carry the charge with the opposite polarity to the developer's adsorbed charge. The cleaning blade can frictionally contact with the photosensitive area's surface of the photosensitive drum through visual image transfer and scrape the remained developer on the photosensitive area's surface of the photosensitive drum into the waste toner chamber.

Chinese Utility Model Patent Number CN2755647Y discloses a developer cartridge that can be removably mounted on a main assembly of an electrophotographic image forming apparatus. The specification of the patent describes the overall structure of the developer cartridge in detail. The main assembly comprises an output contact movable between an electrical connection position and a retracted position, a mobile member used for moving the output contact, and a flexible function member used for flexibly pushing the mobile member toward the retracted position to push the output contact. The developer cartridge comprises an electrophotographic photosensitive drum, a processing device acted on the photosensitive drum and a movable operational member moved relative to the developer cartridge's frame, in which the movable operational member can connect with a permanent connecting member and move relative to the cartridge frame when the developer cartridge is inserted into the apparatus main assembly. And after said connection, the movable operational member can connect with the movable connecting section of the mobile member to make the output contact to move from the retracted position to the electrical connection position by overcoming the elastic force. An input electrical contact is used to receive the connection via the output contact moved to the electrical connection position to start the processing device's voltage. The developer cartridge uses too many electrical connection accessories with complex structures. Thus, the use of a large number of molds is required, its production procedure is so long, and the product assembly process is relatively long and complex.

As shown in FIG. 1 and FIG. 2, an existing developer cartridge 1' is formed by a combination of a developing unit 2' and a processing unit 3' connected to each other. The frame of the processing unit 3' provides a conductive film 4' and a conductive film bearing 5' at one longitudinal end of a charge roller inside the processing unit 3' (not shown). The conductive film bearing 5' extends downward to form a bearing plate 6'. The bearing plate 6' has a left side and a right side parallel to each other, and a bottom perpendicular to the above two sides. The width of the bottom is the thickness of the bearing plate 6'. The conductive film 4' has an input 41', an output 42' and a transmission section 43' connecting the input 41' and the output 42'. The input 41' is electrically connected to the output 42' through the transmission section 43' and connected to the charge roller in order to provide pre-charged bias for the charge roller. The input 41' has a middle contact plate 44' shaped like a bent strip. The middle contact plate 44' comes in close contact with the bottom of the bearing plate 6'.

In the above developer cartridge, the conductive film bearing 5' and the bearing plate 6' formed from its extension are existed in a naked and permanent state. An electrical contact of the image forming apparatus main assembly is also existed in a permanent state. Referring to FIGS. 3, 4 and 5, when the developer cartridge is assembled inside the image forming apparatus main assembly and assembled in place, the middle contact plate 44' of the conductive film 4' can contact with the electrical contact 7' of the image forming apparatus main assembly in its permanent position state to achieve the electrical connection without other extra accessories thereby reducing the complexity of device structure and helping to improve the stability of electrical contact. However, since the conductive film 4' wraps the bearing plate 6' in a single side and contacts the electrical contact 7' only through the middle contact plate 44' with smaller width, and the electrical contact 7' suitable for the developer cartridge in the image forming apparatus main assembly is usually a thin and long metal wire with much smaller width, the scenario in which the electrical contact 7' offsets toward both sides of the middle contact plate 44' as shown in FIG. 4 and FIG. 5 can occur when the developer cartridge is assembled inside the image forming apparatus main assembly and assembled in place. Thus, the phenomenon of bad contact with the middle contact plate 44' occurs. As a result, the image forming apparatus main assembly cannot induce the developer cartridge.

SUMMARY OF THE INVENTION

The primary object of the present invention is to provide a charge roller conductive film having a good contact with an electrical contact of an image forming apparatus main assembly and reliable induction.

Another object of the present invention is to provide a developer cartridge having the above charge roller conductive film.

In order to achieve the above first object, the present invention provides a charge roller conductive film comprising an input contacting an electrical contact of the image forming apparatus main assembly, an output connecting with a charge roller and a transmission section connecting with the input and the output. The input has a middle contact plate shaped like a bent strip. At least one side of said middle contact plate forms a side contact plate.

One optimal solution is that both sides of a middle contact plate form a side contact plate so that regardless of which side of the electrical contact offsets the middle contact plate it can form a contact with side contact plate. In order to enforce the contact effect between the electrical contact and the side contact plate, at least one protrusion can be provided in the outer side of the side contact plate. Said side contact plate and said middle contact plate are best configured to be an integrated structure. Said side contact plate has two pieces in each side of said middle contact plate. Each piece of the side contact plate is roughly trapezoidal.

To achieve the above second object, the present invention provides a developer cartridge having the above charge roller conductive film comprising a developing unit and a processing unit connected to each other. Said processing unit comprises a processing unit frame, a photosensitive drum and a charge roller rotatably assembled on the processing unit frame. Said processing unit frame provides a charge roller conductive film and a conductive bearing plate at one longitudinal end of the charge roller. Said charge roller conductive film comprises an input fixed on said conductive bearing plate and contacting the electrical contact of the image forming apparatus main assembly, an output connecting with the charge roller, and a transmission section connecting with the input and the output. The input has a middle contact plate shaped like a bend strip. At least one side of said middle contact plate forms a side contact plate.

The present invention is further described in conjunction with each embodiment

DETAILED DESCRIPTION OF THE PRESENTLY PREFERRED EMBODIMENTS

In all the drawings, the same label will be used to represent the same parts, character or structure. The specific structure or parts introduced in the embodiments is only used as an indicative example for the ordinary person skill in the art to understand the developer cartridge in the present invention. The ordinary person skill in the art, inspired by the technical solution, can design various identical or similar construction technologies not exceeding the technical scope and substance of the developer cartridge in the present invention. Thus, it is inappropriate if the examples of such instructions are used to limit the protection range claimed for the developer cartridge in the present invention. The identical or similar technical solution in the developer cartridge of the present invention is still in the protection range of the developer cartridge claimed in the present invention. And due to the requirement of simplicity, applicants omit the descriptions of known functions and structures.

Figure 1:
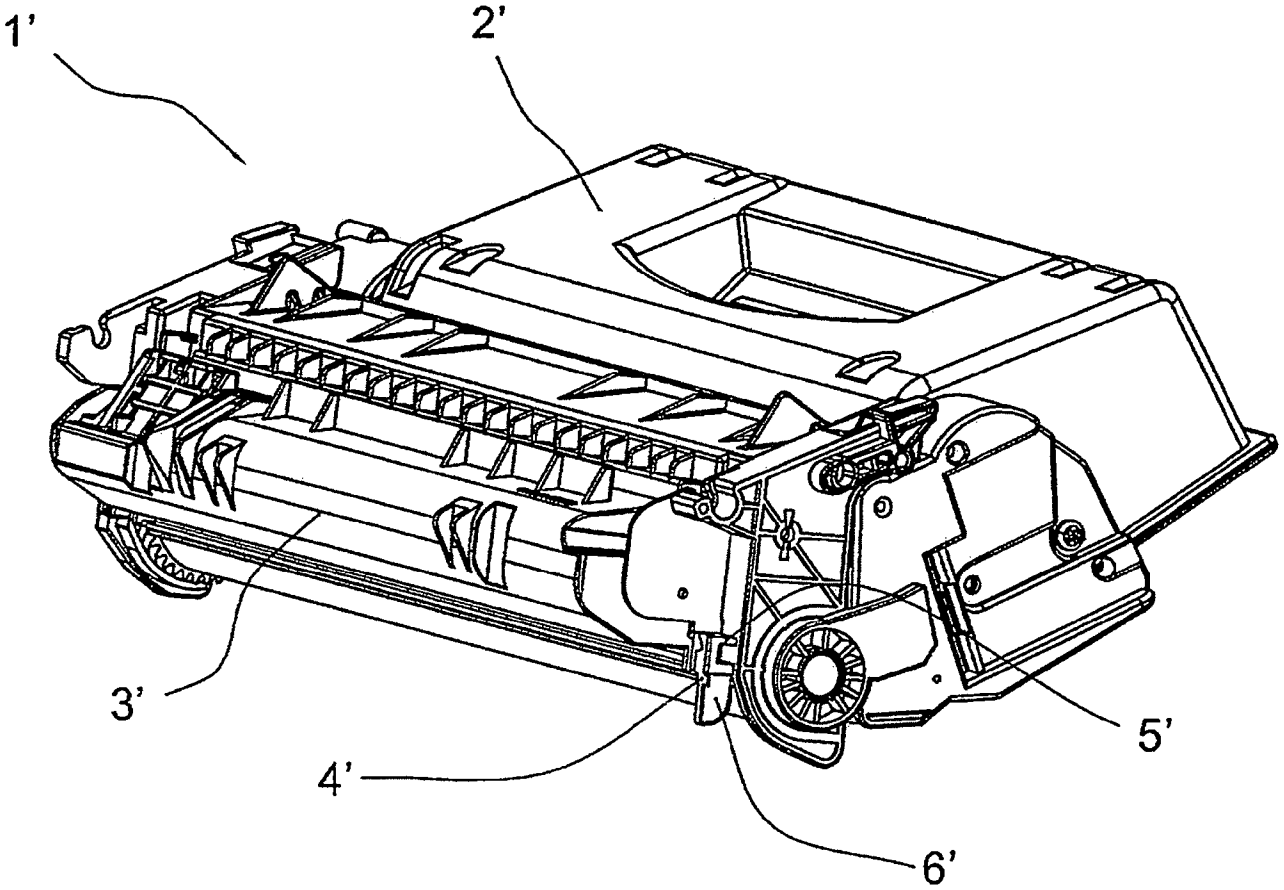
FIG. 1 Prior Art
FIG. 1 is a perspective view illustrating an existing developer cartridge.
Figure 2:
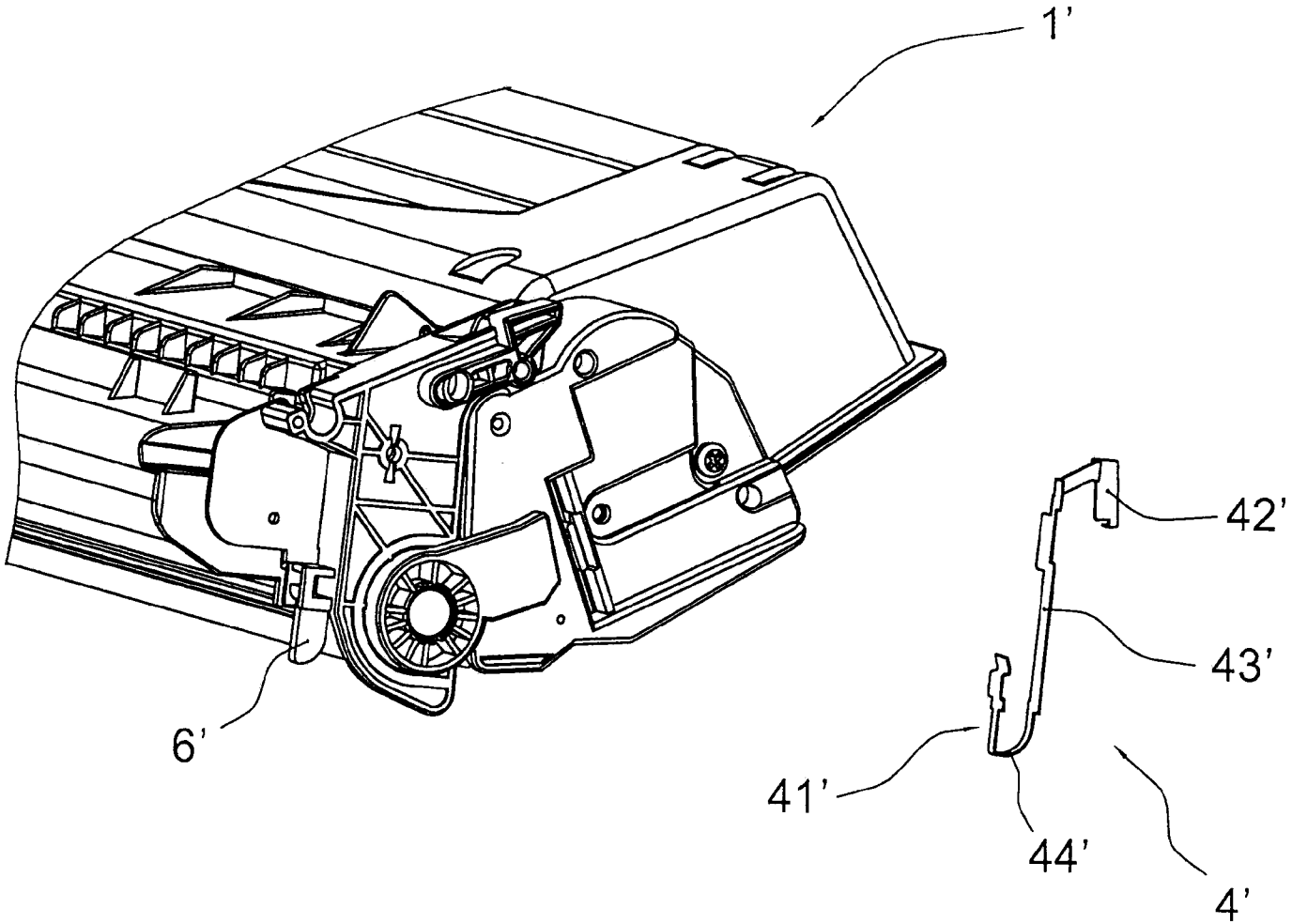
FIG. 2 is a perspective view in partial cut-away of the developer cartridge shown in FIG. 1, in which one end of the developer cartridge and a charge roller conductive film are shown, respectively.
Figure 3:
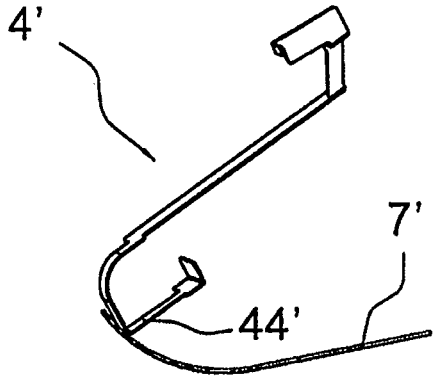
FIG. 3 is a perspective view illustrating a normal contact between the charge roller conductive film of the developer cartridge and an electrical contact of the image forming apparatus main assembly shown in FIG. 1.
Figure 4:
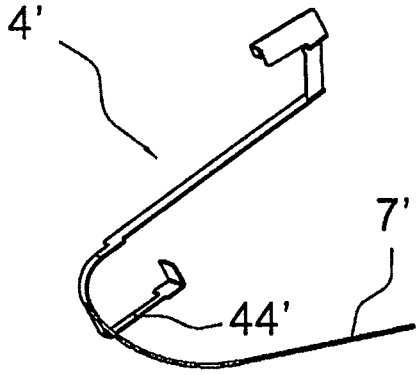
FIG. 4 is a perspective view illustrating the first case in which the charge roller conductive film of the developer cartridge shown in FIG. 1 offsets the electrical contact of the image forming apparatus main assembly thus generating a bad contact.
Figure 5:
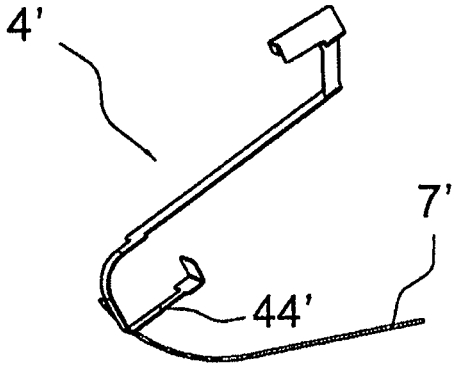
FIG. 5 Prior Art
FIG. 5 is a perspective view illustrating the second case in which the charge roller conductive film of the developer cartridge shown in FIG. 1 offsets the electrical contact of the image forming apparatus main assembly thus generating a bad contact.
Figure 6:
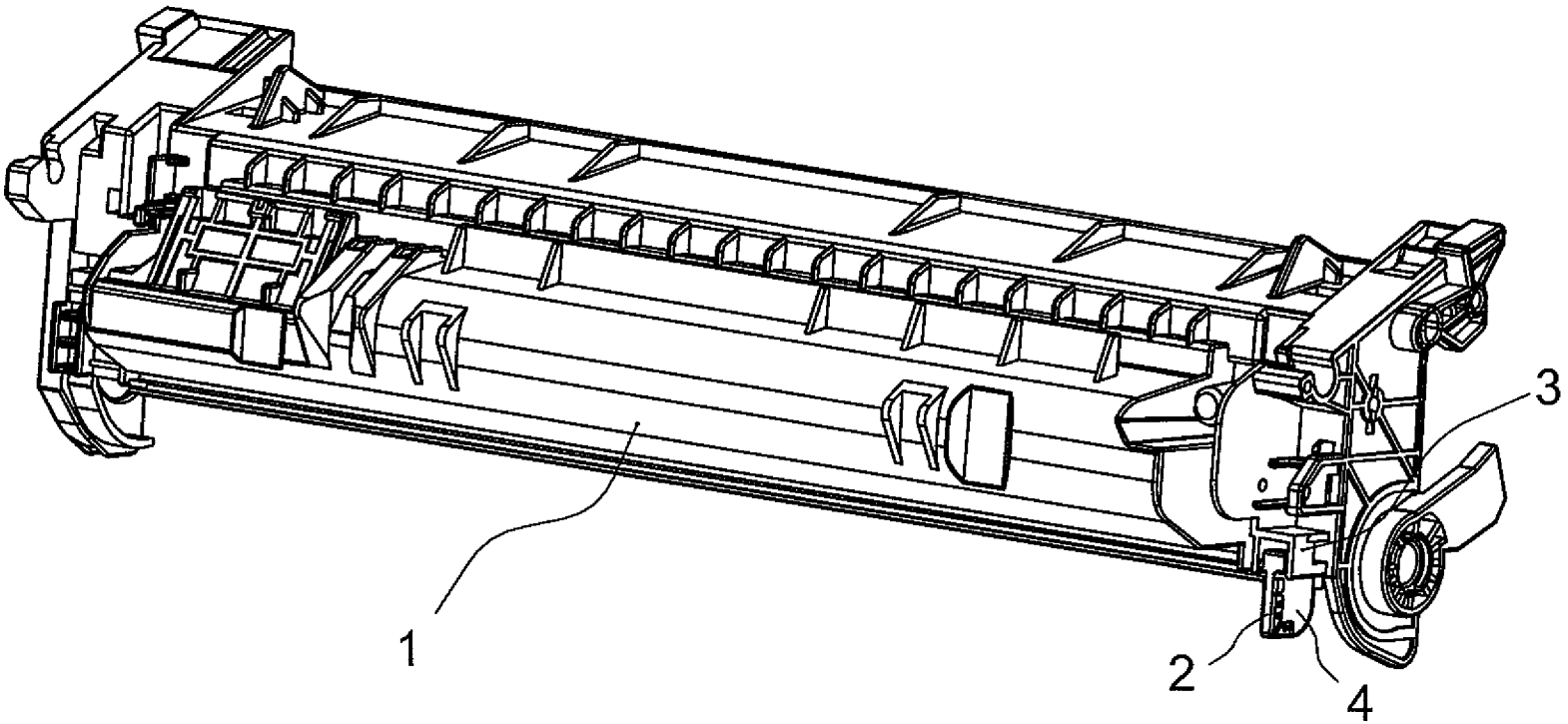
FIG. 6 is a perspective view illustrating a processing unit in an optimal embodiment of the developer cartridge in the present invention.
Figure 7:
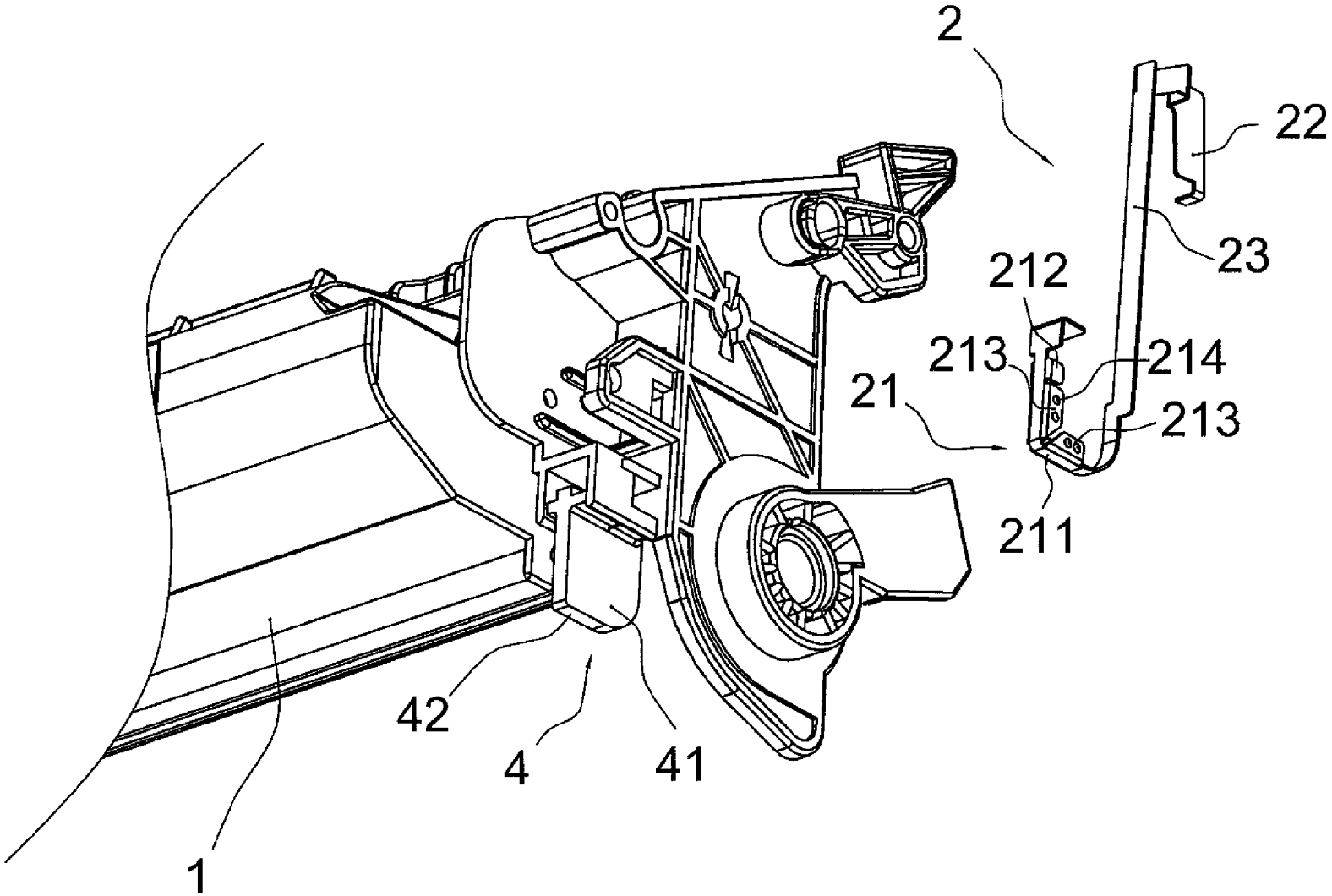
FIG. 7 is a perspective view in partial cut-away of the processing unit shown in FIG. 6, in which a processing unit frame and a charge roller conductive film are shown, respectively.
Figure 8:
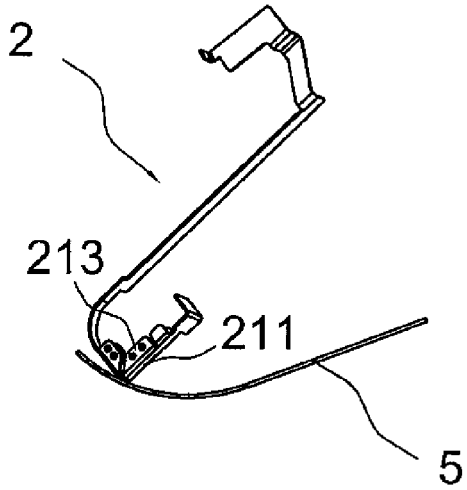
FIG. 8 is a perspective view illustrating a normal contact between the middle contact plate of the charge roller conductive film shown in FIG. 7 and the electrical contact of the image forming apparatus main assembly.
Figure 9:
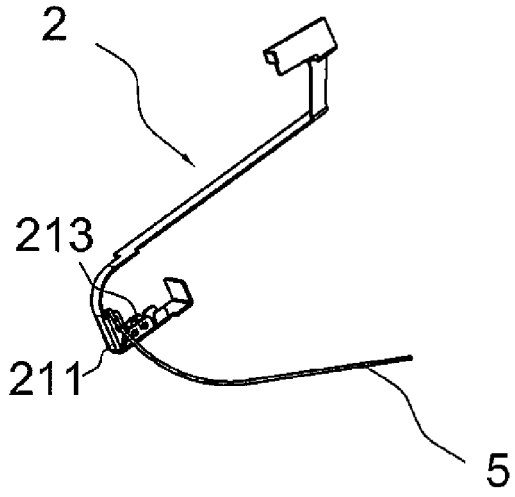
FIG. 9 is a perspective view illustrating a normal contact between the left side contact plate of the charge roller conductive film shown in FIG. 7 and the electrical contact of the image forming apparatus main assembly.
Figure 10:
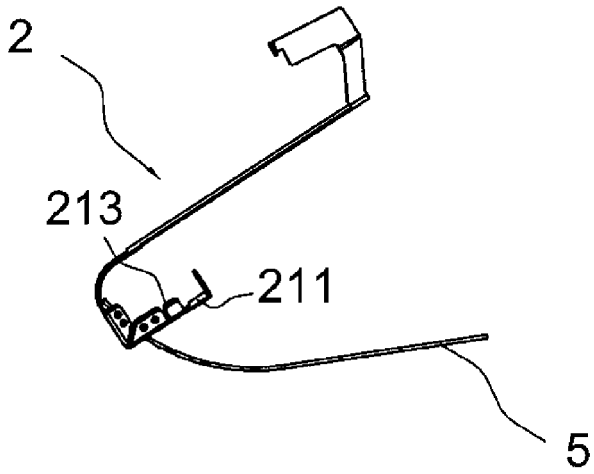
FIG. 10 is a perspective view illustrating a normal contact between the right side contact plate of the charge roller conductive film shown in FIG. 7 and the electrical contact of the image forming apparatus main assembly.

The developer cartridge's main structure in the present invention is roughly similar as the developer cartridge as shown in FIG. 1. The main difference is the charge roller conductive film section. FIG. 6 and FIG. 7 only schematically show the processing unit 1 of the developer cartridge in the present invention but omit the developing unit and other parts identical to or similar as those in the existing technology, such as a photosensitive drum and a charge roller. The processing unit frame 1 provides a conductive film 2 and a conductive film bearing 3 at one longitudinal end (the axial direction of the charge roller). The conductive film bearing 3 extends downward to form a bearing plate 4. The bearing plate 4 has the left side and the right side 41 parallel to each other, and the bottom 42 perpendicular to the above two sides. The width of the bottom 42 is a thickness of the bearing plate 4. The conductive film 2 has an input 21, an output 22 and a transmission section 23 connecting the input 21 and the output 22. The output 22 is electrically connected with the input 21 through the transmission section 23 and the charge roller so as to provide pre-charged bias to the charge roller. The input 21 has a middle contact plate 211 shaped like a bent strip. The middle contact plate 211 comes in close contact with the bottom 42 of the bearing plate 4 while clip 212 at both sides is used to wrap the entire input 21 and fix it on the bearing plate 4. In order to make the charge roller of the develop cartridge and the image forming apparatus main assembly to have better conductivity, and to prevent the image forming apparatus main assembly from not inducing the developer cartridge, two pieces of the side contact plates 213 are formed at two sides of the middle contact plate 211 in the above conductive film 2. Each piece of the side contact plate 213 is roughly trapezoidal and forms an integrated structure with the middle contact plate 211. Thus, the electrical contact 5 of the image forming apparatus main assembly is located whether either below the middle of the conductive film 2 as shown in FIG. 8, or the left or right side offsetting the middle contact plate 211 as shown in FIG. 9 and FIG. 10, the electrical contact 5 can form electrical connection with the conductive film 2 via contacting the middle contact plate 211 or the side contact plate 213. In addition, in order to enforce the contact effect between the electrical contact 5 and the side contact plate 213, two small protrusions 214 are provided on the outer side of each piece of the side contact plate 213.

In a process of assembling a developer cartridge in an image forming apparatus main assembly, the developer cartridge slides slope below into the corresponding positioning slot provided in the image forming apparatus main assembly along the chute on the side wall of the image forming apparatus main box. The position of the conductive film 2 is gradually reduced as the developer cartridge declines. When the developer cartridge reaches the corresponding positioning slot provided in the image forming apparatus main assembly, the input 21 being wrapped around the outside surface of the bearing plate 4 by the conductive film 2 can also reach and contact the position of the electrical contact 5 of the image forming apparatus main assembly. Thus, the conductive film 2 of the developer cartridge can achieve electrical connection with the electrical contact 5 of the image forming apparatus main assembly.

The above is the preferred embodiment. It should be noted that the side contact plate 213 on the conductive film 4 can only be provided at one side of the middle contact plate 211. In addition, the side contact plate 213 located at each side of the middle contact plate 211 can only have one piece, three pieces or more. And the shape of each piece of the side contact plate 213 is not limited to trapezoidal but can be square, rectangular or any arbitrary shapes. In addition, each piece of the side contact plate 213 can also provide a structure form extending from the direction of the middle contact plate 211 far away from the middle contact plate 211 but is not limited to a substantially perpendicular structure form between the side contact plate 213 and the middle contact plate 211 shown in various embodiment drawings. Replacement program like this is in the protection range of the present invention.

INDUSTRIAL APPLICABILITY

Compared to the existing technology, a conductive film in the present invention is added a side contact plate on at least one side of a middle contact plate. When a developer cartridge is assembled in an image forming apparatus main assembly and assembled in place, an electrical contact can reliably contact with the conductive film even if the electrical contact of the image forming apparatus main assembly offsets toward one side of the middle contact plate having the side contact plate. Thus, the charge roller of the developer cartridge and the image forming apparatus main assembly have better conductivity and prevent from the appearance of the phenomenon that the image forming apparatus main assembly cannot induce the developer cartridge.

What is claimed is:

1. A charge roller conductive film, comprising:

an input contacting an electrical contact of an image forming apparatus main assembly, said input having a middle contact plate configured as a bent strip, said bent strip having a contact surface and a side edge;

an output electrically connecting with a charge roller; and a transmission section connecting with said input and said output, wherein a side contact plate is formed at said side edge and oriented at an angle with respect to said contact surface on at least one side of said middle contact plate.

2. The charge roller conductive film according to claim 1, wherein said side contact plate and said middle contact plate configured to be an integrated structure.

3. The charge roller conductive film according to claim 1, wherein said side contact plate has two pieces at each side of said middle contact plate.

4. The charge roller conductive film according to claim 3, wherein each piece of said side contact plate is shaped roughly like trapezoidal.

5. The charge roller conductive film according to claim 1, wherein said side contact plate has formed at both sides of said middle contact plate.

6. The charge roller conductive film according to claim 5, wherein said side contact plate and said middle contact plate are configured to be an integrated structure.

7. The charge roller conductive film according to claim 5, wherein said side contact plate has two pieces at each side of said middle contact plate.

8. The charge roller conductive film according to claim 7, wherein each piece of said side contact plate is shaped roughly like trapezoidal.

9. The charge roller conductive film according to claim 5, wherein the outer side of said side contact plate have at least one protrusion.

10. The charge roller conductive film according to claim 9, wherein said side contact plate and said middle contact plate are configured to be an integrated structure.

11. The charge roller conductive film according to claim 9, wherein said side contact plate has two pieces at each side of said middle contact plate.

12. The charge roller conductive film according to claim 11, wherein each piece of said side contact plate is shaped roughly like trapezoidal.

13. A developer cartridge, comprising a developing unit and a processing unit connected to each other, wherein said processing unit comprises a processing unit frame, a photosensitive drum and a charge roller rotatably assembled on the processing unit frame, said processing unit frame provides a charge roller conductive film and a conductive film bearing plate at one longitudinal end of said charge roller, and said charge roller conductive film comprises an input being fixed on said conductive film bearing plate and contacting an electrical contact of an image forming apparatus main assembly, said input having a middle contact plate configured as a bent strip, said bent strip having a contact surface and a side edge;

an output electrically connecting to said charge roller;

a transmission section connecting to said input and said output; and a side contact plate formed at said side edge and oriented at an angle with respect to said contact surface on at least one side of said middle contact plate.

14. The developer cartridge according to claim 13, wherein said side contact plate and said middle contact plate are configured to be an integrated structure.

15. The developer cartridge according to claim 13, wherein said side contact plate is formed at both sides of said middle contact plate.

16. The developer cartridge according to claim 15, wherein said side contact plate and said middle contact plate are configured to be an integrated structure.

17. The developer cartridge according to claim 15, wherein the outer side of said side contact plate has at least one protrusion.

18. The developer cartridge according to claim 17, wherein said side contact plate and said middle contact plate are configured to be an integrated structure.

* * * * *